US008371558B2

(12) United States Patent
Engleman et al.

(10) Patent No.: US 8,371,558 B2
(45) Date of Patent: Feb. 12, 2013

(54) HOIST APPARATUS

(76) Inventors: Joseph Scott Engleman, Dubois, WY (US); Wesley Darrel Engleman, Evansville, WY (US)

( * ) Notice: Subject to any disclaimer, the term of this patent is extended or adjusted under 35 U.S.C. 154(b) by 348 days.

(21) Appl. No.: 12/774,687

(22) Filed: May 5, 2010

(65) Prior Publication Data

US 2011/0272655 A1 Nov. 10, 2011

(51) Int. Cl.
*B66D 3/04* (2006.01)

(52) U.S. Cl. ..... 254/390; 182/92

(58) Field of Classification Search ..... 254/390, 254/405; 182/92, 142, 187
See application file for complete search history.

(56) References Cited

U.S. PATENT DOCUMENTS

| | | | | |
|---|---|---|---|---|
| 387,436 | A | 8/1888 | O'Neil | |
| 907,483 | A | 12/1908 | Ette | |
| 963,066 | A | 7/1910 | Pringle | |
| 3,298,459 | A | 1/1967 | Bergsten | |
| 4,415,061 | A | 11/1983 | Meyer | |
| 4,697,669 | A * | 10/1987 | Bergsten | 182/92 |
| 4,708,221 | A * | 11/1987 | Kubiak | 182/187 |
| 5,603,489 | A * | 2/1997 | Regal | 254/378 |
| 5,755,178 | A * | 5/1998 | Lush | 119/51.03 |
| 5,806,625 | A * | 9/1998 | Katz | 182/92 |
| 5,908,084 | A * | 6/1999 | Laurin et al. | 182/142 |
| 5,944,139 | A * | 8/1999 | Kozial | 182/92 |
| 6,631,885 | B2 * | 10/2003 | Halas | 254/225 |
| 7,007,927 | B2 * | 3/2006 | Halas | 254/225 |
| 7,134,524 | B2 * | 11/2006 | Sprague | 182/92 |
| 7,410,137 | B2 * | 8/2008 | Diggle et al. | 248/246 |
| 8,132,647 | B2 * | 3/2012 | Salerno | 182/92 |

* cited by examiner

*Primary Examiner* — Emmanuel M Marcelo
(74) *Attorney, Agent, or Firm* — Schwartz, Bon, Walker & Studer, LLC; Peter J. Timbers

(57) ABSTRACT

A screwable hoisting apparatus to aid in elevating objects is described. The apparatus is embedded into a tree with one hand while the tree climber is free to use his other hand to secure himself to the tree. A method for using the same is disclosed.

7 Claims, 2 Drawing Sheets

HOIST APPARATUS

FIELD OF THE INVENTION

This invention relates to a hoist useful for safely raising and lowering items from a tree.

BACKGROUND OF THE INVENTION

Many out door enthusiasts enjoy tree climbing. For some of these enthusiasts, such as hunters, it is essential to secure a safe and effective perch in trees. Having an elevation advantage provides hunters an enhanced view over more terrain than if they were standing on the ground. In many cases, a hunter perched in a tree evades detection by the animals he wishes to observe. Thus, an elevated perch is often an effective means to successfully hunt game animals.

During construction of a tree perch, it is often necessary to elevate objects and items to the desired height. Often a tree climber must carry objects and items while ascending the tree. It is dangerous for the tree climber to both carry and climb. The tree climber uses one hand or some portion of his upper limbs to secure the items and objects for hauling during the ascent and uses the other hand to aid in the ascent up the tree. This precarious situation often results in dropping items and objects, potentially damaging them. The tree climber risks falling from the tree during his ascent.

Once a tree climber attains his desired, elevated height in the tree, the tree climber must often use both hands to attach or assemble the items or objects he has hauled up the tree. This creates additional, serious problems regarding safety. A harness, for securing the tree climber to the tree, is sometimes employed to provide some measure of safety. However, a harness often requires one or both hands to secure it, thereby limiting the hauling ability of the tree climber. Further, many tree climbers do not use a harness because of perceived time constraints or their desire not to haul and carry such a piece of equipment to the tree.

There exists a need for an apparatus effective for elevating items and objects during the course of tree climbing and performing tasks at heights in trees.

SUMMARY OF THE INVENTION

One object of the present invention is to provide an apparatus for safely hoisting various items and objects up a tree or other object penetrable by a screw.

In one embodiment, the current invention comprises a hoist apparatus comprising a pulley, a boring tool and a cable. The pulley comprising a grooved wheel for carrying a line and a block within which the wheel turns. The boring tool comprising a shaft and a crank. The shaft comprises a first end, a second end, and an intermediate portion. The first end of the shaft forms a pointed screw. The intermediate portion of the shaft comprises a first diameter, two, spaced-apart, circumferential raised portions thereon, each raised portion having a diameter larger than the first diameter with the region therebetween having a second diameter which is smaller than the raised portions. The crank for rotating the shaft is disposed on the second end of the shaft. The cable has a first end and a second end, the first end having a loop, the loop having a diameter larger than the second diameter, and the second end attached to the block. The crank comprises an arm and a handle. The arm has a first end and a second end. The handle has a first end and a second end. The first end of the arm is perpendicularly attached at the second end of the shaft, and the first end of the handle is perpendicularly attached to the second end of the arm.

In another embodiment of the present invention, the second end of said handle has a notch therein adapted for receiving said cable between the loop of the cable and the second end of the cable attached to the block. In yet another embodiment of the present invention, the shaft, the arm, and said handle are integrally formed.

In another embodiment of the present invention, the spaced-apart, circumferential raised portions comprise disks. In another embodiment of the present invention, the disks have the same diameter. In another embodiment of the present invention, the loop in said cable is formed from said cable. In yet another embodiment of the present invention, the hoist further comprises a line for being carried by said pulley.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
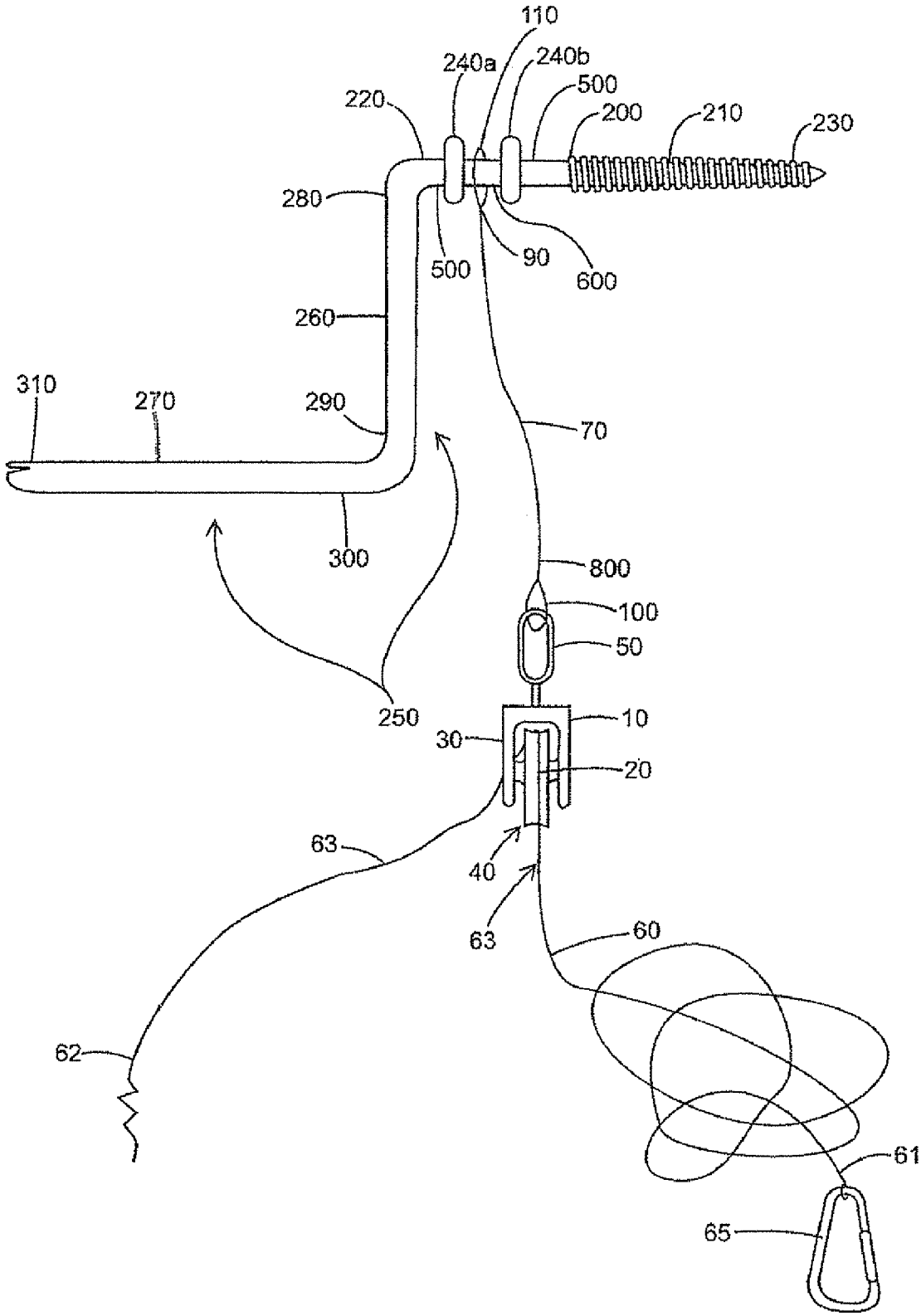
FIG. 1 illustrates a perspective side view of one embodiment of the hoist apparatus.

Reference will now be made in detail to embodiments of the invention, examples of which are illustrated in the accompanying drawings. Throughout the following, the same reference characters refer to the same or similar elements in all figures.

FIG. 1 depicts one embodiment of the present invention. The hoist apparatus comprises a pulley 40 housed inside a block 10. The pulley 40 is located in the inner portion 20 of the block 10. There exists many means of attachment known in the art of attachment whereby a block is attached to a cable. Such knowledge and methods of attachment art are included and incorporated into this invention. The cable 70 has a first end 90, a second end 800 and a width. The first end 800 of the cable 70 has a first loop 110. The second end 800 of the cable 70 has a second loop 100. The second loop 100 on the second end 800 of the cable 70 is attached to the loop 50 on the outer surface 30 of the block 10.

FIG. 1 depicts one embodiment of the invention wherein the rope 60 has a first end 61, a second end 62, and an intermediate portion 63. In FIG. 1, a portion of the intermediate portion 63 of the rope 60 is disposed between the inner portion 20 of the block 10 and the pulley 40. FIG. 1 depicts a carabineer 65 attached to the first end 61 of the rope 60. A carabineer is one means of attaching the rope to the items and objects to be hoisted. Many different means of attaching items and objects are contemplated within the scope of the present invention, including but not limited to clasps, hooks and buckles. It is contemplated within the scope of this invention that the second end of the rope is tied in a knot such that the second end of the rope cannot be pulled entirely through the pulley.

FIG. 1 also depicts the shaft portion 200 having a tapered first end 210, an intermediate section 500 and a second end 220. The tapered first end 210 has a pointed, threaded screw 230 formed thereon. The pointed, threaded screw 230 on the first end 210 allows the shaft portion to screw or rotate the first end 210 of the shaft 200 into trees or other objects penetrable by a screw.

The intermediate section 500 of the shaft 200 comprises a first diameter and two, spaced-apart, circumferential raised portions 240A and 240B. There is a non-elevated region 600 along the intermediate section 500 of the shaft 200 between the two, spaced-apart, circumferential raised portions 240A and 240B. The distance between the two, spaced-apart circumferential raised portions 240A and 240B is sufficiently large enough for the cable to fit therebetween. In FIG. 1, the first loop 110 of the first end 90 of the cable 70 is attached to the shaft 200 at the non-elevated region 600 of the shaft 200 between the two, spaced-apart, circumferential raised portions 240A and 240B. The diameters of the two, spaced-apart, circumferential raised portions 240A and 240B are larger than the inside diameter of the first loop 110 of the first end 90 of the cable 70. This prevents the cable from detaching, once it is attached to the shaft portion 200.

The cross sectional diameter of the non-elevated region 600 along the intermediate section 500 of the shaft 200 between the two, spaced-apart, circumferential raised portions 240A and 240B is smaller than the inside diameter of the first loop 110 of the first end 90 of the cable 70. This allows the shaft to rotate and penetrate a tree or other object penetrable by a screw without rotating the cable and entangling or winding the cable around the shaft.

FIG. 1 also depicts a crank 250 having an arm portion 260 and a handle 270. The arm 260 has a first end 280 and a second end 290. The handle 270 has a first end 300 and a second end 310. The arm 260 is generally perpendicular to both the shaft 200 and handle 270. The shaft 200 and the handle 270 are generally parallel, but not co-linear. The first end 280 of the arm 260 is adapted for attachment to the second end 220 of the shaft portion 220. The second end 290 of the arm portion 260 is adapted for attachment to the first end 300 of the handle portion 270.

FIG. 1 depicts the second end 220 of the shaft 200 integrally formed with and attached to the first end 280 of the arm 260 of the crank 250. FIG. 1 also depicts the second end 290 of the arm 260 of the crank 250 integrally formed with and attached to the first end 300 of the handle 270 of the crank 250.

Figure 2:
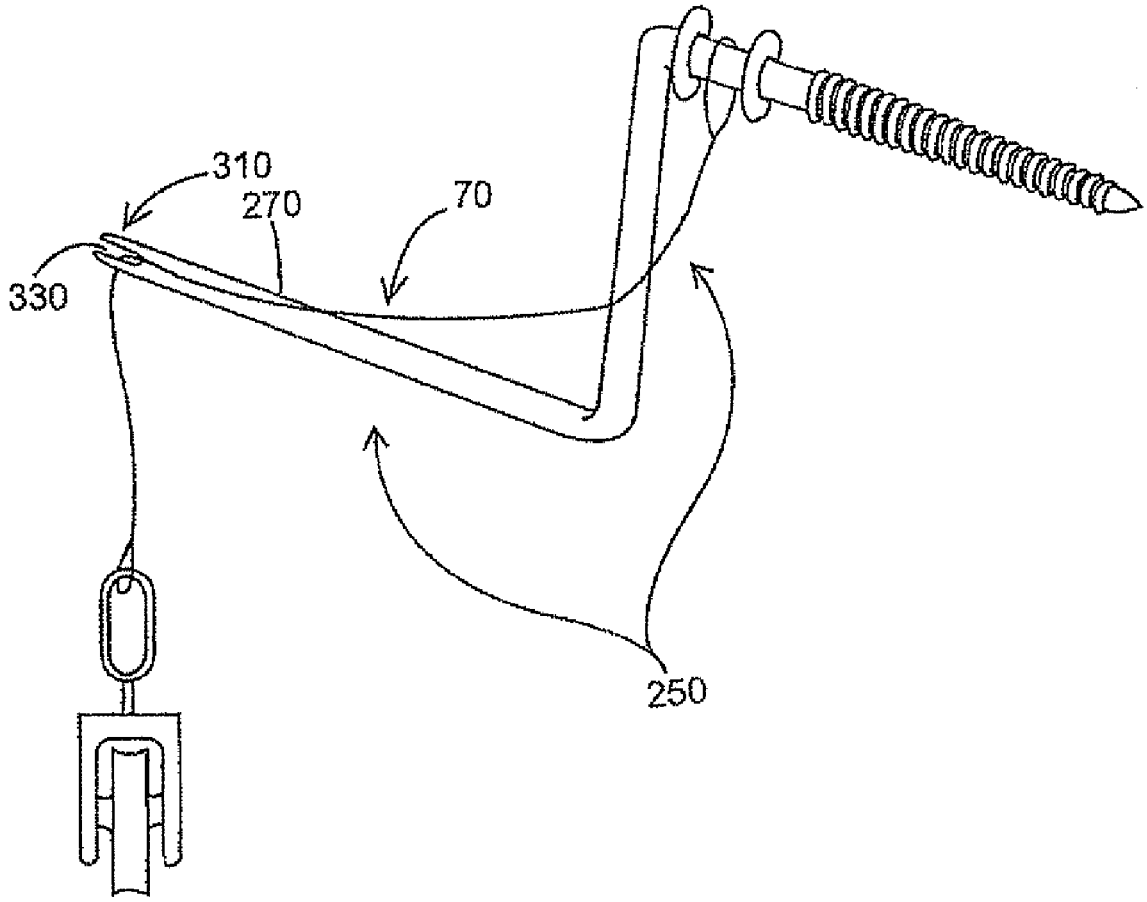
FIG. 2 illustrates a perspective top view of an embodiment of the hoist apparatus.

FIG. 2 depicts a notch 330 in the second end 310 of the handle 270 of the crank 250. The notch 330 has width, which is at least as wide as the width of the cable 70. In at least one embodiment, the end 310 of the handle 270 is bent towards the arm of the crank. The notch 330 provides a location for the cable 70 to be secured and attached to the handle of the crank. The cable is thereby extended away from the tree, such that the items and objects being hoisted up the tree will not come into contact with the tree as they are elevated.

In practice, a climber climbs to a desired height and commences rotating the crank and screwing the shaft into the tree or other object penetrable by the screw. The shaft is screwed into the tree with one hand and the climber uses his other hand to secure himself to the tree. As the shaft portion is screwed into an object, the cable is not fitted through the notch, but rather left hanging from the shaft. The cable does not rotate as the shaft is screwed into the tree. Upon having screwed the shaft portion into a tree or other object penetrable by the screw, the cable is inserted into the groove at the second end of the handle portion. The climber then descends and the pulley is then utilized to elevate and hoist objects to the pulley via the line. The rope can then be tied off, thereby securing the hoisted objects at the height of the pulley.

It is believed that the apparatus of the present invention, and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described, being merely exemplary and explanatory embodiments thereof. It is the intention of the following claims to encompass and include such changes.

What is claimed is:

1. A hoist comprising:

a pulley comprising a grooved wheel for carrying a line and a block within which said wheel turns;

a boring tool comprising a shaft and a crank, the shaft comprising a first end, a second end, and an intermediate portion, the first end forming a pointed screw, the intermediate portion having a first diameter, two, spaced-apart, circumferential raised portions thereon, each raised portion having a diameter larger than the first diameter with the region therebetween having a second, smaller diameter than the raised portions, the crank for rotating the shaft disposed on the second end of the shaft;

a cable having a first end and a second end, the first end having a loop, the loop having a diameter larger than the second diameter, and the second end attached to said block;

wherein said crank comprises an arm and a handle, the arm having a first end and a second end, the handle having a first end and a second end, the first end of the arm perpendicularly attached to the second end of the shaft, and the first end of the handle perpendicularly attached to the second end of said arm; and wherein the second end of said handle has a notch therein adapted for receiving said cable between the loop of the cable and the second end of the cable attached to said block.

2. The hoist of claim 1, wherein said shaft, said first arm, and said handle are integrally formed.

3. The hoist of claim 1, wherein each of said two, spaced-apart, circumferential raised portions comprises a disk.

4. The hoist of claim 3, wherein the disks have the same diameter.

5. The hoist of claim 1, wherein the loop of said cable is formed from said cable.

6. The hoist of claim 1, wherein the hoist further comprises a line for being carried by said pulley.

7. The hoist of claim 1, wherein the second end of the handle is bent toward the arm of the crank.

* * * * *